US006042980A

United States Patent [19]

Kierstein et al.

[11] Patent Number: 6,042,980

[45] Date of Patent: Mar. 28, 2000

[54] PHOTOCONDUCTOR WITH CHARGE GENERATION BINDER BLEND

[75] Inventors: Laura Lee Kierstein, Johnstown; Kasturi Rangan Srinivasan, Longmont, both of Colo.

[73] Assignee: Lexmark Internatonal, Inc., Lexington, Ky.

[21] Appl. No.: 09/120,057

[22] Filed: Jul. 21, 1998

[51] Int. Cl.[7] ..... G03G 5/047; G03G 5/04

[52] U.S. Cl. ..... 430/58.4; 430/58.8; 430/59.1; 430/96

[58] Field of Search ..... 430/58.4, 58.8, 430/59.1, 96

[56] References Cited

U.S. PATENT DOCUMENTS

| | | | |
|---|---|---|---|
| 3,955,977 | 5/1976 | Bailey | 430/67 |
| 4,353,971 | 10/1982 | Chang et al. | 430/78 |
| 4,391,888 | 7/1983 | Change et al. | 430/64 |
| 4,489,148 | 12/1984 | Horgan | 430/60 |
| 4,559,287 | 12/1985 | McAneney et al. | 430/900 |
| 4,582,772 | 4/1986 | Teuscher et al. | 430/62 |
| 4,983,483 | 1/1991 | Tsai | 430/73 |
| 5,094,930 | 3/1992 | Nomori et al. | 430/96 |
| 5,102,758 | 4/1992 | Kazmaier et al. | 430/73 |
| 5,130,215 | 7/1992 | Adley et al. | 430/96 |
| 5,130,217 | 7/1992 | Champ et al. | 430/96 |
| 5,213,923 | 5/1993 | Yokoyama et al. | 430/58.25 |
| 5,223,361 | 6/1993 | Mishra et al. | 430/96 |
| 5,270,139 | 12/1993 | Yeng et al. | 430/78 |
| 5,322,755 | 6/1994 | Allen et al. | 430/59.1 |
| 5,545,499 | 8/1996 | Balthis et al. | 430/96 |
| 5,578,406 | 11/1996 | Ojima et al. | 430/58.65 |
| 5,863,689 | 1/1999 | Takei et al. | 430/83 |

FOREIGN PATENT DOCUMENTS

| | | |
|---|---|---|
| 0220489 | 5/1987 | European Pat. Off. . |
| 0415864 | 3/1991 | European Pat. Off. . |
| 0795791 | 9/1997 | European Pat. Off. . |
| 61-62038 | 3/1986 | Japan . |
| 61-73770 | 4/1986 | Japan . |

*Primary Examiner*—Roland Martin
*Attorney, Agent, or Firm*—John A. Brady

[57] ABSTRACT

Charge generation layers for photoconductors comprise a binder and a charge generation compound, wherein the binder comprises a blend of polyvinylbutyral polymer and at least one resin which improves at least one electrical characteristic of a photoconductor in which the charge generation layer is included. Photoconductors comprise the charge generation layer in combination with a substrate and a charge transport layer.

32 Claims, No Drawings

PHOTOCONDUCTOR WITH CHARGE GENERATION BINDER BLEND

FIELD OF THE INVENTION

The present invention is directed to charge generation layers for a photoconductor which comprise a binder and a charge generation compound, wherein the binder comprises a blend of a polyvinylbutyral polymer and at least one resin which improves at least one electrical characteristic of a photoconductor in which the charge generation layer is included, particularly as compared with that of a photoconductor containing a charge generation layer in which the binder comprises polyvinylbutyral in the absence of the resin. The invention is also directed to photoconductors including such a charge generation layer, and to dispersions for preparing such charge generation layers.

BACKGROUND OF THE INVENTION

In electrophotography, a latent image is created on the surface of an imaging member such as a photoconducting material by first uniformly charging the surface and then selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to use of a charge transport layer which comprises a hole transport material as the charge transport compound. One skilled in the art will appreciate that if the charge transport layer contains an electron transport material rather than a hole transport material, the charge placed on a photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises the charge generation compound or molecule, for example a squaraine pigment, a phthalocyanine, or an azo compound, alone or in combination with a binder. The charge transport layer typically comprises a polymeric binder containing the charge transport compound or molecule. The charge generation compounds within the charge generation layer are sensitive to image-forming radiation and photogenerate electron-hole pairs therein as a result of absorbing such radiation. The charge transport layer is usually non-absorbent of the image-forming radiation and the charge transport compounds serve to transport holes to the surface of a negatively charged photoconductor. Photoconductors of this type are disclosed in the Adley et al U.S. Pat. No. 5,130,215 and the Balthis et al U.S. Pat. No. 5,545,499.

The Champ et al U.S. Pat. No. 5,130,217 discloses photoconductors where the charge generation layer comprises solution squarylium formulations. The Chang et al U.S. Pat. Nos. 4,391,888 and 4,353,971 disclose the use of a mixture of charge generation compounds in a charge generation layer, in the absence of a polymer binder. Such layers generally exhibit poor adhesion to underlying layers and hence result in delamination of the layers, particularly under high temperature and/or high humidity conditions. Additionally, while it is known to prepare charge generation layers from solutions of charge generation compounds, with or without binders, typical solvents which are employed comprise amine solvents such as morpholine and pyrrolidine. These solvents are environmentally hazardous and the solutions generally have short pot lives, for example about two hours. Thus, the use of such solutions is cumbersome and results in high manufacturing costs.

A polymer binder provides the charge generation layer with improved mechanical integrity and may improve adherence of the charge generation layer to the underlying layer, for example a photoconductor substrate. Various references have disclosed the use of polyvinylbutyral as a binder for the charge generation layer, including Japanese Reference No. 61-73770 (1986), the Yeng et al U.S. Pat. No. 5,270,139, the Tsai U.S. Pat. No. 4,983,483 and Law, *Journal of Imaging Science,* 31(3):83–92 (1987). The use of polyvinylbutyral as a charge generation layer binder is advantageous in that it significantly improves the adhesion of the charge generation layer to the substrate. Unfortunately, polyvinylbutyral can disadvantageously effect electrical characteristics of the resulting photoconductor in causing, inter alia, high dark decay and residual voltage properties. Japanese Reference No. 61-62038 (1986) and the McAneney et al U.S. Pat. No. 4,559,287 disclose the use of polyesters as a binder for charge generation layers, while European Reference No. 415,864 discloses the use of a copolyestercarbonate as a binder for a charge generation layer. European Reference No. 220,489 further discloses the use of an arylsulfonamide resin along with a polyester adhesive as a binder for a charge generation layer. Photoconductors including charge generation layers formed from these binders generally exhibit good electrical characteristics, but the adhesion of the charge generation layers to the substrates are typically relatively poor, particularly at high temperature and/or high humidity conditions. The poor adhesion of the charge generation layer to the substrate results in delamination of the layer from the substrate and therefore a reduced useful life for the photoconductor. Poor adhesion of the charge generation layer may also result in leaching or washing of the charge generation layer into the solution or dispersion from which the charge transport layer is subsequently formed during manufacture of the photoconductor.

Accordingly, there is a continuing need for photoconductors including charge generation layers which exhibit good adhesion to underlying substrates and exhibit good electrical characteristics.

SUMMARY OF THE INVENTION

Accordingly, it is an object of the present invention to provide novel charge generation layers which overcome disadvantages of the prior art It is a more specific object of the invention to provide charge generation layers which exhibit good adhesion to underlying layers. It is a further object of the invention to provide charge generation layers which do not disadvantageously effect good electrical characteristics of photoconductors in which they are employed. It is a further object of the invention to provide charge generation layers which may be conveniently prepared from dispersions while avoiding the use of conventional, environmentally-hazardous solvents. An additional object of the invention is to provide photoconductors which incorporate such charge generation layers.

These and additional objects and advantages are provided by charge generation layers and photoconductors of the present invention. The charge generation layers comprise a binder and a charge generation compound, wherein the binder comprises a blend of a polyvinylbutyral polymer and at least one resin which improves at least one electrical characteristic of a photoconductor in which the charge generation layer is included, particularly as compared with that of a photoconductor containing a charge generation layer in which the binder comprises polyvinylbutyral in the absence of the resin. Preferably the resin comprises an epoxy resin, a phenoxy, a phenolic resin, or a polyhydroxystyrene. The photoconductors comprise a substrate, a charge generation layer and a charge transport layer, wherein the charge generation layer comprises a binder and a charge generation compound, and further wherein the binder comprises a blend of a polyvinylbutyral polymer and at least one resin which improves at least one electrical characteristic of a photoconductor containing the charge generation layer as described.

The binders according to the present invention surprisingly provide a stable dispersion of charge generation compound from which the charge generation layer may be formed. The charge generation layers exhibit good adhesion to underlying layers, particularly photoconductor substrates, while improving electrical characteristics of the photoconductors, for example reducing dark decay and/or improving sensitivity, as compared with photoconductors which contain a charge generation layer in which the binder comprises polyvinylbutyral in the absence of the resin. These and additional objects and advantages will be more readily apparent in view of the following detailed description.

DETAILED DESCRIPTION

The charge generation layers according to the present invention are suitable for use in dual layer photoconductors. Such photoconductors generally comprise a substrate, a charge generation layer and a charge transport layer. While various embodiments of the invention discussed herein refer to the charge generation layer as being formed on the substrate, with the charge transport layer formed on the charge generation layer, it is equally within the scope of the present invention for the charge transport layer to be formed on the substrate with the charge generation layer formed on the charge transport layer.

The charge generation layers according to the present invention comprise a binder and a charge generation compound. Various organic and inorganic charge generation compounds are known in the art, any of which are suitable for use in the charge generation layers of the present invention. One type of charge generation compound which is particularly suitable for use in the charge generation layers of the present invention comprises the squarylium-based pigments, including squaraines. Squarylium pigment may be prepared by an acid route such as that described in U.S. Pat. Nos. 3,617,270, 3,824,099, 4,175,956, 4,486,520 and 4,508,803, which employs simple procedures and apparatus, has a short reaction time and is high in yield. The squarylium pigment is therefore very inexpensive and is easily available.

Preferred squarylium pigments suitable for use in the present invention may be represented by the structural formula (I)

(I)

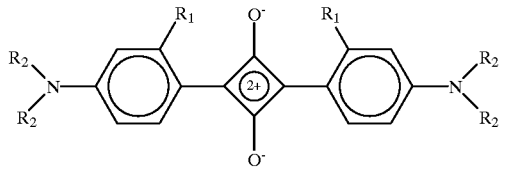

wherein $R_1$ represents hydroxy, hydrogen or $C_{1-5}$ alkyl, preferably hydroxy, hydrogen or methyl, and each $R_2$ individually represents $C_{1-5}$ alkyl or hydrogen. In a further preferred embodiment, the pigment comprises a hydroxy squaraine pigment wherein each $R_1$ in the formula (I) set forth above comprises hydroxy.

Another type of pigment which is particularly suitable for use in the charge generation layers of the present invention comprises the phthalocyanine-based compounds. Suitable phthalocyanine compounds include both metal-free forms such as the X-form metal-free phthalocyanines and the metal-containing phthalocyanines. In a preferred embodiment, the phthalocyanine charge generation compound may comprise a metal-containing phthalocyanine wherein the metal is a transition metal or a group IIIA metal. Of these metal-containing phthalocyanine charge generation compounds, those containing a transition metal such as copper, titanium or manganese or containing aluminum as a group IIIA metal are preferred. These metal-containing phthalocyanine charge generation compounds may further include oxy, thiol or dihalo substitution. Titanium-containing phthalocyanines as disclosed in U.S. Pat. Nos. 4,664,997, 4,725,519 and 4,777,251, including oxo-titanyl phthalocyanines, and various polymorphs thereof, for example type IV polymorphs, and derivatives thereof, for example halogen-substituted derivatives such as chlorotitanyl phthalocyanines, are suitable for use in the charge generation layers of the present invention.

Additional conventional charge generation compounds known in the art, including, but not limited to, disazo compounds, for example as disclosed in the Ishikawa et al U.S. Pat. No. 4,413,045, and tris and tetrakis compounds as known in the art, are also suitable for use in the charge generation layers of the present invention. It is also within the scope of this invention to employ a mixture of charge generation pigments or compounds in the charge generation layer.

In accordance with an important feature of the invention, the charge generation layer binder comprises a blend of binder components. The blend comprises a polyvinylbutyral polymer and at least one resin which improves at least one electrical characteristic of a photoconductor in which the charge generation layer is included, particularly as compared with that of a photoconductor containing a charge generation layer in which the binder comprises polyvinylbutyral in the absence of the resin. Preferred resins comprise epoxy resins, phenoxy resins, phenolic resins and polyhydroxystyrenes. The present inventors have discovered that these binder blends surprisingly form stable dispersions with charge generation compounds and allow formation of charge generation layers having good adhesion to underlying layers while improving electrical characteristics of photoconductors in which the charge generation layers are included. Particularly, the binder blends provide the photoconductors with improved electrical characteristics such as reduced dark decay, improved sensitivity, and/or the like. These advantages provided by the charge generation layers of the present invention are particularly surprising since the use of polyvinylbutyral polymer alone as a binder generally results in a charge generation layer which disadvantageously effects the electrical characteristics of a photoconductor while epoxy resins, phenoxy resins, phenolic resins and polyhydroxystyrenes generally lack the ability to create a stable coating dispersion, causing phase separation of the pigment and binder in the coating dispersion used to form the charge generation layer. The use of higher resin solids in such dispersions typically results in a charge generation layer which is unacceptably thick and which exhibits undesirably high optical densities. On the other hand, the binder according to the present invention which comprises a blend of a polyvinylbutyral polymer and at least one resin as defined overcomes these disadvantages.

Polyvinylbutyral polymers are well known in the art and are commercially available from various sources. These polymers are typically made by condensing polyvinyl alcohol with butyraldehyde in the presence of an acid catalyst, for example sulfuric acid, and contain a repeating unit of formula (II):

(II)

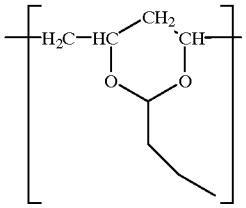

Typically, the polyvinylbutyral polymer will have a number average molecular weight of from about 20,000 to about 300,000.

The polyvinylbutyaral polymer is combined with at least one resin which improves electrical characteristics of a photoconductor containing the charge generation layer, as described above. Preferably, the resin comprises an epoxy resin, a phenoxy resin, a phenolic resin, or a polyhydroxystyrene, or a derivative thereof. All of these resins are well known in the art and are commercially available from various sources. Generally, epoxy resins are formed from an epoxy compound such as epichlorohydrin and contain epoxide groups before crosslinking. Commonly, epoxy resins are formed by condensing epichlorohydrin with bisphenol A, preferably using an excess of epichlorohydrin in order to ensure epoxide groups are contained at each end of the resulting polymer. Such epoxy resins are generally of the following formula (II):

(III)

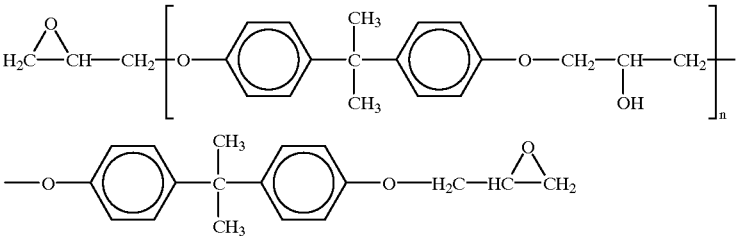

The epoxy resins typically have a number average molecular weight of from about 3,000 to about 10,000, although higher molecular weight epoxy resins may also be used.

Similarly, phenoxy resins are well known in the art and are commercially available from various sources. Phenoxy resins are commonly formed from epichlorohydrin and bisphenol A, but do not contain epoxy groups. The phenoxy resins generally have a repeating unit of the following formula (IV):

(IV)

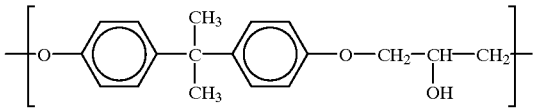

and typically have a number average molecular weight of from about 2,000 to about 40,000.

Phenolic resins are also well known in the art, are commercially available, and typically comprise a repeating unit of the following formula (V):

(V)

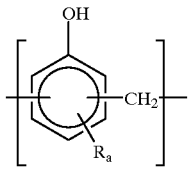

wherein R comprises a $C_{1-8}$ alkyl group and a is from 0 to 3. Novolac resins are common phenolic resins. Additionally, phenolic resins in which the hydroxy group is converted to an epoxide or substituted epoxide group, commonly referred to as an epoxy novolac, are included within the scope of the phenolic resins suitable for use in the blends of the present invention. The phenolic resins typically have a number average molecular weight of at least about 600.

Finally, the polyhydroxystyrenes are typically of the following formula (VI):

(VI)

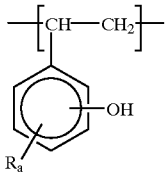

wherein R comprises a $C_{1-8}$ alkyl group and a is from 0 to 3. Polyhydroxystyrene novolacs are included within the scope of the polyhydroxystyrenes suitable for use in the present blends. Typically, the polyhydroxystyrenes will have a number average molecular weight of from about 4,000 to about 20,000.

Generally, the binder comprises the resin in an amount sufficient to improve an electrical characteristic of a photoconductor which includes the charge generation layer, particularly as compared with a photoconductor containing a charge generation layer wherein the binder is formed only of the polyvinylbutyral polymer. Typically, the binder comprises the polyvinylbutyral polymer and the resin in a weight ratio from about 1:50 to about 50:1 and preferably comprises the polyvinylbutyaral polymer and the resin in a weight range of from about 1:20 to about 20:1. In further preferred embodiments, the charge generation layers according to the present invention include a binder which comprises the polyvinylbutyral polymer and the resin in a weight ratio of from about 1:20 to about 1:1, whereby at least about half of the binder comprises at least one of the epoxy resin, the phenoxy resin, the phenolic resin or the polyhydroxystyrene.

The charge generation layers may comprise the charge generation compound and the binder in amounts conventionally used in the art. Typically, the charge generation layer may comprise from about 5 to about 80 weight percent of the charge generation compound, preferably comprises at least about 10 weight percent of the charge generation compound, and more preferably comprises from about 15 to about 60 weight percent of the charge generation compound, and may comprise from about 20 to about 95 weight percent of the binder, preferably comprises not more than about 90 weight percent of the binder, and more preferably comprises from about 40 to about 85 weight percent of the binder, all weight percentages being based on the charge generation layer. The charge generation layers may further contain any conventional additives known in the art for use in charge generation layers.

To form the charge generation layers according to the present invention, the binder and the charge generation compound are dissolved and dispersed, respectively, in an organic liquid. Although the organic liquid may generally be referred to as a solvent, and typically dissolves the binder, the liquid technically forms a dispersion of the pigment rather than a solution. The binder and pigment may be added to the organic liquid simultaneously or consecutively, in any order of addition. Suitable organic liquids are preferably essentially free of amines and therefore avoid environmental hazards conventionally incurred with the use of amine solvents. Suitable organic liquids include, but are not limited to, tetrahydrofuran, cyclopentanone, and the like. Additional solvents suitable for dispersing the charge generation compound and binder blend will be apparent to those skilled in the art.

In accordance with techniques generally known in the art, the dispersion preferably contains not greater than about 10 weight percent solids comprising both binder and charge generation compound in combination. The dispersions may therefore be used to form a charge generation layer of desired thickness, typically not greater than about 5 microns, and more preferably not greater than about 1 micron, in thickness. Additionally, because the binder comprising a blend of a polyvinylbutyral polymer and at least one resin as described herein forms a stable dispersion with the charge generation compound in the organic liquid, a homogeneous layer may be easily formed using conventional techniques, for example dip coating or the like. These dispersions also reduce any wash or leach of the charge generation compound into a charge transport layer coating which is subsequently applied to the charge generation layer.

As discussed above, the charge generation layers according to the present invention exhibit good adhesion to underlying layers. Typically, the charge generation layer will be applied to a photoconductor substrate, with a charge transport layer formed on the charge generation layer. In accordance with techniques known in the art, one or more barrier layers may be provided between the substrate and the charge generation layer. Typically, such barrier layers have a thickness of from about 0.05 to about 20 microns. It is equally within the scope of the present invention that the charge transport layer is first formed on the photoconductor substrate, followed by formation of the charge generation layer on the charge transport layer.

The photoconductor substrate may be flexible, for example in the form of a flexible web or a belt, or inflexible, for example in the form of a drum. Typically, the photoconductor substrate is uniformly coated with a thin layer of a metal, preferably aluminum, which functions as an electrical ground plane. In a further preferred embodiment, the aluminum is anodized to convert the aluminum surface into a thicker aluminum oxide surface. Alternatively, the ground plane member may comprise a metallic plate formed, for example, from aluminum or nickel, a metallic drum or foil, or a plastic film on which aluminum, tin oxide, indium oxide or the like is vacuum evaporated. Typically, the photoconductor substrate will have a thickness adequate to provide the required mechanical stability. For example, flexible web substrates generally have a thickness of from about 0.01 to about 0.1 microns, while drum substrates generally have a thickness of from about 0.75 mm to about 1 mm.

The charge transport layer included in the dual layer photoconductors of the present invention comprises binder and a charge transport compound. The charge transport layer is in accordance with conventional practices in the art and therefore may include any binder and any charge transport compound generally known in the art for use in dual layer photoconductors. Typically, the binder is polymeric and may comprise, but is not limited to, vinyl polymers such as polyvinyl chloride, polyvinylbutyral, polyvinyl acetate, styrene polymers, and copolymers of these vinyl polymers, acrylic acid and acrylate polymers and copolymers, polycarbonate polymers and copolymers, including polycarbonate-A, derived from bisphenol A, polycarbonate-Z, derived from cyclohexylidene bisphenol, polycarbonate-C, derived from methyl bisphenol-A, polyestercarbonates, polyesters, alkyd resins, polyamides, polyurethanes, epoxy resins and the like. Preferably, the polymeric binder of the charge transport layer is inactive, i.e., it does not exhibit charge transporting properties.

Conventional charge transport compounds suitable for use in the charge transport layer of the photoconductors of the present invention should be capable of supporting the injection of photo-generated holes or electrons from the charge generation layer and allowing the transport of these holes or electrons through the charge transport layer to selectively discharge the surface charge. Suitable charge transport compounds for use in the charge transport layer include, but are not limited to, the following:

1. Diamine transport molecules of the types described in U.S. Pat. Nos. 4,306,008, 4,304,829, 4,233,384, 4,115,116, 4,299,897, 4,265,990 and/or 4,081,274. Typical diamine transport molecules include benzidine compounds, including substituted benzidine compounds such as the N,N'-diphenyl-N,N'-bis(alkylphenyl)-[1,1'-biphenyl]-4,4'-diamines wherein the alkyl is, for example, methyl, ethyl, propyl, n-butyl, or the like, or halogen substituted derivatives thereof, and the like.

2. Pyrazoline transport molecules as disclosed in U.S. Pat. Nos. 4,315,982, 4,278,746 and 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3(p-diethylaminostyryl)-5-(p-diethylaminophenyl)pyrazoline, 1-phenyl-3-[p-diethylaminostyryl]-5-(p-dimethylaminostyryl)pyrazoline, 1-phenyl-3-[p-diethylaminostyryl]-5-(p-diethylaminostyryl) pyrazoline, and the like.

3. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2,4'-dimethoxybenzylidene)fluorene, 2-nitro-9-benzylidene-fluorene, 2-nitro-9-(4'-diethylaminobenzylidene)fluorene and the like.

4. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.

5. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

Preferably, the charge transport compound included in the charge transport layer comprises a hydrazone, an aromatic amine (including aromatic diamines such as benzidine), a substituted aromatic amine (including substituted aromatic diamines such as substituted benzidines), or a mixture thereof. Preferred hydrazone transport molecules include derivatives of aminobenzaldehydes, cinnamic esters or hydroxylated benzaldehydes. Exemplary aminobenzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. applications Ser. Nos. 08/988,600 and 08/988,791, now U.S. Pat. No. 5,925,486, respectively, all of which patents and applications are incorporated herein by reference.

The charge transport layer typically comprises the charge transport compound in an amount of from about 5 to about 60 weight percent, based on the weight of the charge transport layer, and more preferably in an amount of from about 15 to about 40 weight percent, based on the weight of the charge transport layer, with the remainder of the charge transport layer comprising the binder, and any conventional additives.

The charge transport layer will typically have a thickness of from about 10 to about 40 microns and may be formed in accordance with conventional techniques known in the art. Conveniently, the charge transport layer may be formed by dispersing or dissolving the charge transport compound in a polymeric binder and organic solvent, coating the dispersion and/or solution on the respective underlying layer and drying the coating.

The following examples demonstrate various embodiments and advantages of the charge generation layers, dispersions and photoconductors according to the present invention. In the examples and throughout the present specification, parts and percentages are by weight unless otherwise indicated.

EXAMPLE 1

In this example, photoconductors according to the present invention and comparative photoconductors were prepared using charge generation layers according to the present invention and conventional charge generation layers, respectively. Each of the photoconductors described in this example was prepared by dip coating a charge generation layer dispersion on an anodized aluminum drum substrate and drying to form the charge generation layer, followed by dip coating a charge transport layer dispersion on the charge generation layer and drying to form the charge transport layer. In each photoconductor of this example, the charge transport layer comprised about 60 weight percent of a bisphenol A-polycarbonate polymer (Makrolon-5208 supplied by Bayer) and about 40 weight percent of a charge transport compound comprising p-diethylaminobenzaldehyde(diphenylhydrazone) (DEH).

The composition of the charge generation layer for each of photoconductors 1A-1I of this example is described in Table I. In each of the photoconductors, the charge generation compound comprised hydroxy squaraine ((2,4-bis(4-dimethylamino-2-hydroxyphenyl)cyclobutenediylium-1,3-diolate)). The charge generation layers of photoconductors 1A, 1C and 1G were comparative layers and comprised a binder comprising polyvinylbutyral (PVB) of a number average molecular weight, Mn, of about 98,000 g/mol, supplied by Sekisui Chemical Company under the designation BX-55Z and having the following general formula (VII):

(VII)

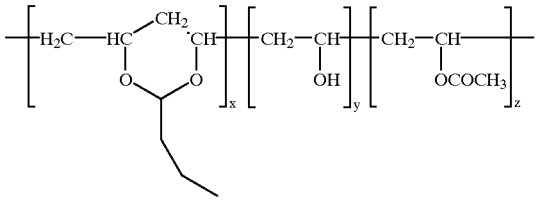

On the other hand, photoconductors 1B, 1 D–F, 1H and 1I contained charge generation layers according to the present invention wherein the binder comprised a blend of polyvinylbutyral and an epoxy resin in the weight ratios indicated in Table I. The epoxy resin was formed from epichlorohydrin and bisphenol A, supplied by Shell Chemical Company under the designation Epon 1009 and having a number average molecular weight, Mn, of about 9881 g/mol. The charge generation layer of each photoconductor was formed from a dispersion of the hydroxy squaraine and the respective binder dispersed in a mixture of tetrahydrofuran and cyclopentanone. The respective dispersions generally contained about 5–6 weight percent solids.

The optical density and various electrical characteristics of the photoconductors described in this example were examined. Specifically, optical density was measured using a Macbeth TRS24 densitometer. Dark decay, which is the loss of charge from the surface of the photoconductor when it is maintained in the dark, was also measured. Dark decay is an undesirable feature as it reduces the contrast potential between image and background areas, leading to washed out images and loss of gray scale. Dark decay also reduces the field that the photoconductive process will experience when light is brought back to the surface, thereby reducing the operational efficiency of the photoconductor. Finally, sensitivity measurements were made using an electrostatic sensitometer fitted with electrostatic probes to measure the voltage magnitude as a function of light energy shining on the photoconductor surface using a 780 nm laser. The drum was charged by a corona and the expose-to-develop time for all measurements was 222 ms. The photosensitivity was measured as the discharge voltage on the photoconductor drum previously charged to about −650 V, measured at a light energy of 0.9 microjoules/cm$^2$. The results of all of these measurements are set forth in Table I.

The results set forth in Table I demonstrate that each of the photoconductors 1B, 1D–1F, 1H and 1I according to the present invention and containing a charge generation layer having a binder blend exhibited significantly reduced dark decay and/or significantly reduced residual voltage relative to the respective comparative photoconductors 1A, 1C and 1G which contained similar amounts of charge generation compound but contained a PVB binder rather than a binder blend of PVB and the epoxy resin Similar improvements were observed in photoconductors according to the present invention wherein the epoxy resin blended with the polyvinylbutyral in the charge generation layer binder had a number average molecular weight, Mn, ranging from about 3,000 to about 10,000 g/mol.

The photoconductors according to the invention in this example, 1B, 1D–1F, 1H and 1I, were also tested for their adhesion behavior using the tape lift-off method according to ASTM D3359. The photoconductors according to the invention exhibited good overall adhesion, similar to that of the comparative photoconductors and significantly better than that of conventional photoconductors wherein the charge generation layer is formed from a hydroxy squaraine solution or from a copolyestercarbonate-hydroxy squaraine dispersion.

EXAMPLE 2

In this example, additional photoconductors according to the present invention and additional comparative photoconductors were prepared comprising charge generation layers according to the present invention and comparative charge generation layers, respectively. Each photoconductor was prepared using the general procedures described in Example 1. The charge transport layer for the photoconductors of this example comprised about 70 weight percent of the bisphenol A-polycarbonate binder described in Example 1 and about 30 weight percent of a benzidine charge transport compound comprising N,N'-bis(3-methylphenyl)-N,N'-bisphenolbenzidine (TPD).

The compositions of the charge generation layers of the respective photoconductors according to this example are described in Table II wherein the referenced charge generation compound comprises hydroxy squaraine, and the PVB and epoxy resin are as described in Example 1. As will be apparent from Table II, photoconductors 2B, 2D–2F, 2H and 2I are according to the present invention and contain a charge generation layer according to the present invention wherein the binder comprises a blend of polyvinylbutyral and an epoxy resin, while photoconductors 2A, 2C and 2G are comparative photoconductors and contain a charge generation layer comprising polyvinylbutyral alone rather than

TABLE I

| Photo-conductor | Charge Generation Compound (wt. %) | Binder (Blend wt. ratio) | Optical Density | Dark Decay (V/sec) | Initial Charge (−V) | Residual Voltage at 0.9 μJ/cm$^2$(−V) |
|---|---|---|---|---|---|---|
| 1A | 20 | PVB | 1.4 | 75 | 692 | 254 |
| 1B | 20 | PVB/Epoxy Resin(1:9) | 1.05 | 15 | 612 | 211 |
| 1C | 30 | PVB | 1.11 | 60 | 650 | 218 |
| 1D | 30 | PVB/Epoxy Resin(1:9) | 0.96 | 11 | 612 | 178 |
| 1E | 35 | PVB/Epoxy resin(1:9) | 1.08 | 11 | 611 | 196 |
| 1F | 38 | PVB/Epoxy Resin(1:9) | 1.1 | 20 | 611 | 186 |
| 1G | 40 | PVB | 1.37 | 28 | 601 | 225 |
| 1H | 40 | PVB/Epoxy Resin(1:9) | 1.25 | 24 | 618 | 161 |
| 1I | 40 | PVB/Epoxy Resin(1:3) | 1.32 | 28 | 618 | 158 |

in a blend. The charge generation layer of each photoconductor was formed from a dispersion as generally described in Example 1.

The photoconductors of this example were subjected to measurement of optical density, dark decay and photosensitivity according to the procedures described in Example 1. The results of these measurements are set forth in Table II.

TABLE II

| Photo-conductor | Charge Generation Compound (wt. %) | Binder (Blend wt. ratio) | Optical Density | Dark Decay (V/sec) | Initial Charge (−V) | Residual Voltage at 0.9 $\mu J/cm^2$(−V) |
|---|---|---|---|---|---|---|
| 2A | 20 | PVB | 1.2 | 176 | 650 | 552 |
| 2B | 20 | PVB/Epoxy Resin(1:9) | 1.01 | 11 | 611 | 187 |
| 2C | 30 | PVB | 1.3 | 143 | 650 | 284 |
| 2D | 30 | PVB/Epoxy Resin(1:9) | 0.99 | 23 | 612 | 165 |
| 2E | 35 | PVB/Epoxy resin(1:9) | 1.03 | 12 | 610 | 140 |
| 2F | 38 | PVB/Epoxy Resin(1:9) | 1.05 | 25 | 610 | 126 |
| 2G | 40 | PVB | 1.37 | 34 | 601 | 170 |
| 2H | 40 | PVB/Epoxy Resin(1:9) | 1.25 | 24 | 614 | 94 |
| 2I | 40 | PVB/Epoxy Resin(1:3) | 1.29 | 28 | 614 | 94 |

From the results set forth in Table II, one of ordinary skill in the art will recognize that in photoconductor 2A, wherein the charge generation layer comprises about 20 weight percent hydroxy squaraine and about 80 weight percent polyvinylbutyral binder, the charge generation layer does not inject into the benzidine-containing charge transport layer, as evidenced by the significant residual voltage. However, in photoconductor 2B according to the present invention, also containing about 20 weight percent hydroxy squaraine and about 80 weight percent binder in the charge generation layer, but wherein the binder comprises a blend of polyvinylbutyral and epoxy resin, the charge injection at the charge generation layer-charge transport layer interface is dramatically improved, resulting in a significantly reduced residual voltage and thereby providing a functional photoconductor. Photoconductors 2D–2F, 2H and 2I also exhibited substantial reductions in dark decay and sensitivity as compared with the respective comparative photoconductors 2C and 2G containing similar amounts of charge generation compound.

The photoconductors of this example according to the invention (2B, 2D–2F, 2H and 2I) were also examined for their adhesion behavior according to ASTM D3359, and exhibited good overall adhesion, similar to that of the comparative photoconductors 2A, 2C and 2G, and significantly better than that of conventional photoconductors containing charge generation layers formed from a hydroxy squaraine solution or a copolyestercarbonate-hydroxy squaraine dispersion.

EXAMPLE 3

In this example, additional photoconductors according to the present invention were prepared using the general procedures described in Example 1. The charge transport layer of the respective photoconductors contained either TPD as the charge transport compound or DEH as the charge transport compound as set forth in Table III, in the amounts indicated, and the bisphenol A-polycarbonate binder described in Example 1.

The charge generation layer of each photoconductor of this example included a binder comprising a blend of the polyvinylbutyra (PVB) described in Example 1 and either a phenolic resin or a phenoxy resin. The phenolic resin (PHL) was supplied by Schenectady International under the designation HRJ 11482 and was of the general formula (VII):

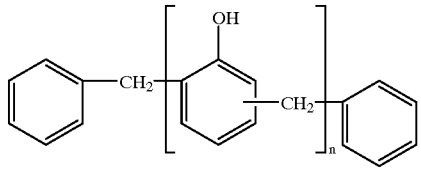

The phenoxy resin (PHX) was supplied by Phenoxy Associates under the designation PKHJ and had the following formula (IX):

(IX)

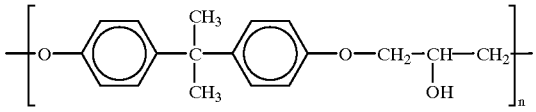

The specific binder compositions for each of the photoconductors 3A–3E according to the present invention in this example are described in Table III.

The photoconductors of this example were subjected to measurement of optical density, dark decay and sensitivity in accordance with the procedures described in Example 1. The results of these measurements are also set forth in Table III. For comparison purposes, several of the comparative photoconductors of Examples 1 and 2, and their various properties, are included in Table III.

TABLE III

| Photo-conductor | Charge Generation Compound (wt. %) | Binder (Blend wt. ratio) | Charge Transport Compound (wt %) | Optical Density | Dark Decay (V/sec) | Initial Charge (−V) | Residual Voltage at 0.9 $\mu J/cm^2$(−V) |
|---|---|---|---|---|---|---|---|
| 2A | 20 | PVB | TPD(30%) | 1.2 | 176 | 650 | 552 |
| 3A | 20 | PVB/PHL(1:9) | TPD(30%) | 0.98 | 15 | 600 | 380 |
| 3B | 20 | PVB/PHX(1:9) | TPD(30%) | 1.12 | 15 | 600 | 245 |
| 1A | 20 | PVB | DEH(40%) | 1.4 | 75 | 692 | 254 |
| 3C | 20 | PVB/PHX(1:9) | DEH(40%) | 1.07 | 13 | 612 | 178 |
| 2G | 40 | PVB | TPD(30%) | 1.37 | 34 | 601 | 170 |
| 3D | 45 | PVB/PHL(1:9) | TPD(30%) | 1.08 | 17 | 600 | 145 |
| 1G | 40 | PVB | DEH(40%) | 1.37 | 28 | 601 | 225 |
| 3E | 45 | PVB/PHL(1:9) | DEH(40%) | 1.13 | 28 | 600 | 208 |

The results set forth in Table III demonstrate that photoconductors 3A–3E exhibit reduced dark decay and improved photosensitivity as compared with the respective comparative photoconductors having similar amounts of charge generating compound therein. The photoconductors according to the invention in this example also exhibited good adhesion behavior when tested according to the tape lift off methods of ASTM-3359.

Thus, these examples demonstrate that the photoconductors according to the present invention exhibit good electrical characteristics and the charge generation layers thereof exhibit good adhesion to the underlying substrate. These examples also demonstrate that the charge generation layers may be easily formed from stable dispersions using organic liquids which are environmentally friendly as compared with conventional solvents.

The various preferred embodiments and examples set forth herein are presented in order to further illustrate the claimed invention and are not to be limiting thereof. Additional embodiments and alternatives within the scope of the claimed invention will be apparent to one of ordinary skill in the art.

What is claimed is:

1. A charge generation layer for a photoconductor, comprising a binder and a charge generation compound, wherein the binder comprises a blend of a polyvinylbutyral polymer and at least one resin selected from the group consisting of an epoxy resin, a phenoxy resin, a phenolic resin and a polyhydroxystyrene, the at least one are being included in an amount which improves at least one electrical characteristic of a photoconductor in which the charge generation layer is included.

2. A charge generation layer for a photoconductor as defined by claim 1, wherein the charge generation compound comprises a squarylium pigment.

3. A charge generation layer for a photoconductor as defined by claim 1, wherein the charge generation compound comprises a hydroxy-substituted squarylium pigment.

4. A charge generation layer for a photoconductor as defined by claim 1, wherein the binder comprises the polyvinylbutyral polymer and the resin in a weight ratio of from about 1:50 to about 50:1.

5. A charge generation layer for a photoconductor as defined by claim 1, wherein the binder comprises the polyvinylbutyral polymer and the resin in a weight ratio of from about 1:20 to about 20:1.

6. A charge generation layer for a photoconductor as defined by claim 1, wherein the binder comprises the polyvinylbutyral polymer and the resin in a weight ratio of from about 1:20 to about 20:1.

7. A charge generation layer for a photoconductor as defined by claim 6, wherein the binder comprises the polyvinylbutyral polymer and the epoxy resin.

8. A charge generation layer for a photoconductor as defined by claim 6, wherein the binder comprises the polyvinylbutyral polymer and the phenoxy resin.

9. A charge generation layer for a photoconductor as defined by claim 6, wherein the binder comprises the polyvinylbutyral polymer and the phenolic resin.

10. A charge generation layer for a photoconductor as defined by claim 6, wherein the binder comprises the polyvinylbutyral polymer and the polyhydroxystyrene.

11. A charge generation layer for a photoconductor as defined by claim 1, comprising from about 5 to about 80 weight percent of the charge generation compound and from about 20 to about 95 weight percent of the binder.

12. A photoconductor, comprising a substrate, a charge generation layer and a charge transport layer, wherein the charge generation layer comprises a binder and a charge generation compound, and further wherein the binder comprises a blend of a polyvinylbutyral polymer and at least one resin selected from the group consisting of an epoxy resin, a phenoxy resin, a phenolic resin and a polyhydroxystyrene, the at least one resin being included in an amount which improves at least one electrical characteristic of the photo conductor.

13. A photoconductor as defined by claim 12, wherein the charge generation compound comprises a squarylium pigment.

14. A photoconductor as defined by claim 13, wherein the charge transport layer comprises a binder and a benzidine charge transport compound.

15. A photoconductor as defined by claim 14, wherein the charge generation layer comprises from about 5 to about 80 weight percent of the charge generation compound and from about 20 to about 95 weight percent of the binder.

16. A photoconductor as defined by claim 13, wherein the charge transport layer comprises a binder and a hydrazone charge transport compound.

17. A photoconductor as defined by claim 16, wherein the charge generation layer comprises from about 5 to about 80 weight percent of the charge generation compound and from about 20 to about 95 weight percent of the binder.

18. A photo conductor, comprising a substrate, a charge generation layer and a charge transport layer, wherein the charge generation layer comprises from about 20 to about 95 weight percent binder and from about 5 to about 80 weight percent of a squarylium charge generation compound, and further wherein the binder comprises a blend of a polyvinylbutyral polymer and at least one resin selected from the group consisting of an epoxy resin, a phenoxy resin, a phenolic resin and a polyhydroxystyrene, the at least one resin being included in an amount which improves an electrical characteristic of the photoconductor.

19. A photoconductor as defined by claim 18, wherein the binder comprises the polyvinylbutyral polymer and the resin in a weight ratio of from about 1:20 to about 1:1.

20. A photoconductor as defined by claim 19, wherein the charge transport layer comprises a binder and a benzidine charge transport compound.

21. A photoconductor as defined by claim 19, wherein the charge transport layer comprises a binder and a hydrazone charge transport compound.

22. A dispersion for preparing a charge generation layer, comprising a squarylium pigment and a binder which are stably dispersed in an organic liquid, wherein the binder comprises a blend of a polyvinylbutyral polymer and at least one resin selected from the group consisting of an epoxy resin, a phenoxy resin, a phenolic resin and a polyhydroxystyrene, the at least one resin being included in an amount which improves at least one electrical characteristic of a photoconductor containing a charge generation layer formed from the dispersion.

23. A dispersion as defined by claim 22, wherein the organic liquid comprises tetrahydrofuran, cyclopentanone, or mixtures thereof.

24. A dispersion as defined by claim 22, wherein the organic liquid is essentially free of amines.

25. A photoconductor as defined by claim 12, wherein the charge generation layer binder comprises a blend of polyvinylbutyral polymer and an epoxy resin having a number average molecular weight of from about 3000 to about 10,000.

26. A photoconductor as defined by claim 25, wherein the epoxy resin is generally of the formula (III)

(III)

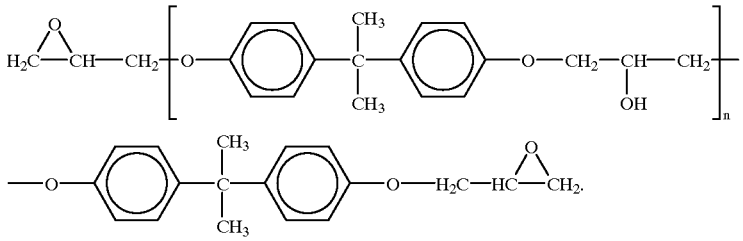

27. A photoconductor as defined by claim 12, wherein the charge generation layer binder comprises a blend of polyvinylbutyral polymer and a phenoxy resin having a number average molecular weight of from about 2000 to about 40,000.

28. A photoconductor as defined by claim 27, wherein the phenoxy resin has a repeating unit of the following formula (IV)

(IV)

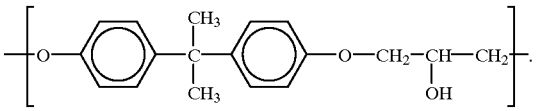

29. A photoconductor as defined by claim 12, wherein the charge generation layer binder comprises a blend of polyvinylbutyral polymer and a phenolic resin having a number average molecular weight of at least about 600.

30. A photoconductor as defined by claim 29, wherein the phenolic resin has a repeating unit of the following formula (V)

(V)

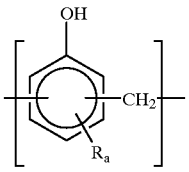

wherein R comprises a $C_{1-8}$ alkyl group and a is from 0 to 3, and optionally wherein the hydroxy group is converted to an epoxide or substituted epoxide group.

31. A photoconductor as defined by claim 12, wherein the charge generation layer binder comprises a blend of polyvinylbutyral polymer and a polyhydroxystyrene having a number average molecular weight of from about 4000 to about 20,000.

32. A photoconductor as defined by claim 31, wherein the polyhydroxystyrene is generally of the formula (VI)

(VI)

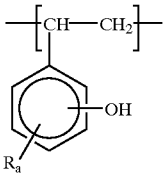

wherein R comprises a $C_{1-8}$ alkyl group and is from 0 to 3.

* * * * *

UNITED STATES PATENT AND TRADEMARK OFFICE

CERTIFICATE OF CORRECTION

PATENT NO : 6,042,980

DATED : March 28, 2000

INVENTOR(S) : Laura Lee Kierstein, et al.

It is certified that error appears in the above-identified patent and that said Letters Patent is hereby corrected as shown below:

Claim 1, col. 15, line 43:
Change "are" to read -- resin --.

Claim 12, col. 16, lines 36-37:
Change "photo conductor." to read -- photoconductor. --.

Signed and Sealed this

Twenty-seventh Day of March, 2001

*Attest:*

*Attesting Officer*

NICHOLAS P. GODICI

*Acting Director of the United States Patent and Trademark Office*